US005483315A

United States Patent [19]

Hehn

[11] Patent Number: 5,483,315

[45] Date of Patent: Jan. 9, 1996

[54] APPARATUS FOR WET PROCESSING PHOTOGRAPHIC SHEETS

[75] Inventor: Wilfried Hehn, Munich, Germany

[73] Assignee: Agfa-Gevaert Aktiengesellschft, Munich, Germany

[21] Appl. No.: 225,465

[22] Filed: Apr. 8, 1994

[30] Foreign Application Priority Data

Apr. 8, 1993 [DE] Germany ..... 43 11 642.6

[51] Int. Cl.[6] ..... G03D 3/08

[52] U.S. Cl. ..... 354/320; 354/322; 354/321

[58] Field of Search ..... 354/317–324, 354/339, 313; 226/181, 189

[56] References Cited

U.S. PATENT DOCUMENTS

| | | | |
|---|---|---|---|
| 4,326,791 | 4/1982 | Beer et al. | 354/321 |
| 4,837,593 | 6/1989 | Hehn | 354/322 |

FOREIGN PATENT DOCUMENTS

| | | | |
|---|---|---|---|
| 2832820 | 7/1978 | Germany . | |
| 3032809 | 4/1982 | Germany | 354/320 |
| 3614253 | 8/1987 | Germany . | |
| 61-4059 | 1/1986 | Japan | 354/322 |
| 62-240970 | 10/1987 | Japan | 354/320 |
| 3-177838 | 8/1991 | Japan | 354/323 |

*Primary Examiner*—D. Rutledge
*Attorney, Agent, or Firm*—Darby & Darby

[57] ABSTRACT

An apparatus for developing exposed sheets of photographic material has a developing tank and a fixing tank which are separated by a vertical dividing wall, Each of the tanks has a transporting system for continuously transporting the exposed sheets through the respective tank, A transferring unit is located adjacent the upper end of the dividing wall and functions to transfer the sheets from the developing tank to the fixing tank without interruption, The transferring unit includes a pair of withdrawing rollers which grip the sheets as they emerge from the developing tank and a pair of feeding rollers which receive the sheets from the withdrawing rollers and advance the sheets into the fixing tank, The axes of the rollers are parallel to one another. The axes of the withdrawing rollers lie in a first plane which is inclined to the horizontal at an angle of 30 to 60 degrees and the axes of the feeding rollers lie in an oppositely inclined second plane which likewise makes an angle of 30 to 60 degrees with the horizontal, The withdrawing rollers cooperate with the feeding rollers to define a trough-like space and a guide roller projects into this space, The guide roller intercepts the leading ends of the sheets as they emerge from the withdrawing rollers and directs the leading ends to the feeding rollers,

9 Claims, 1 Drawing Sheet

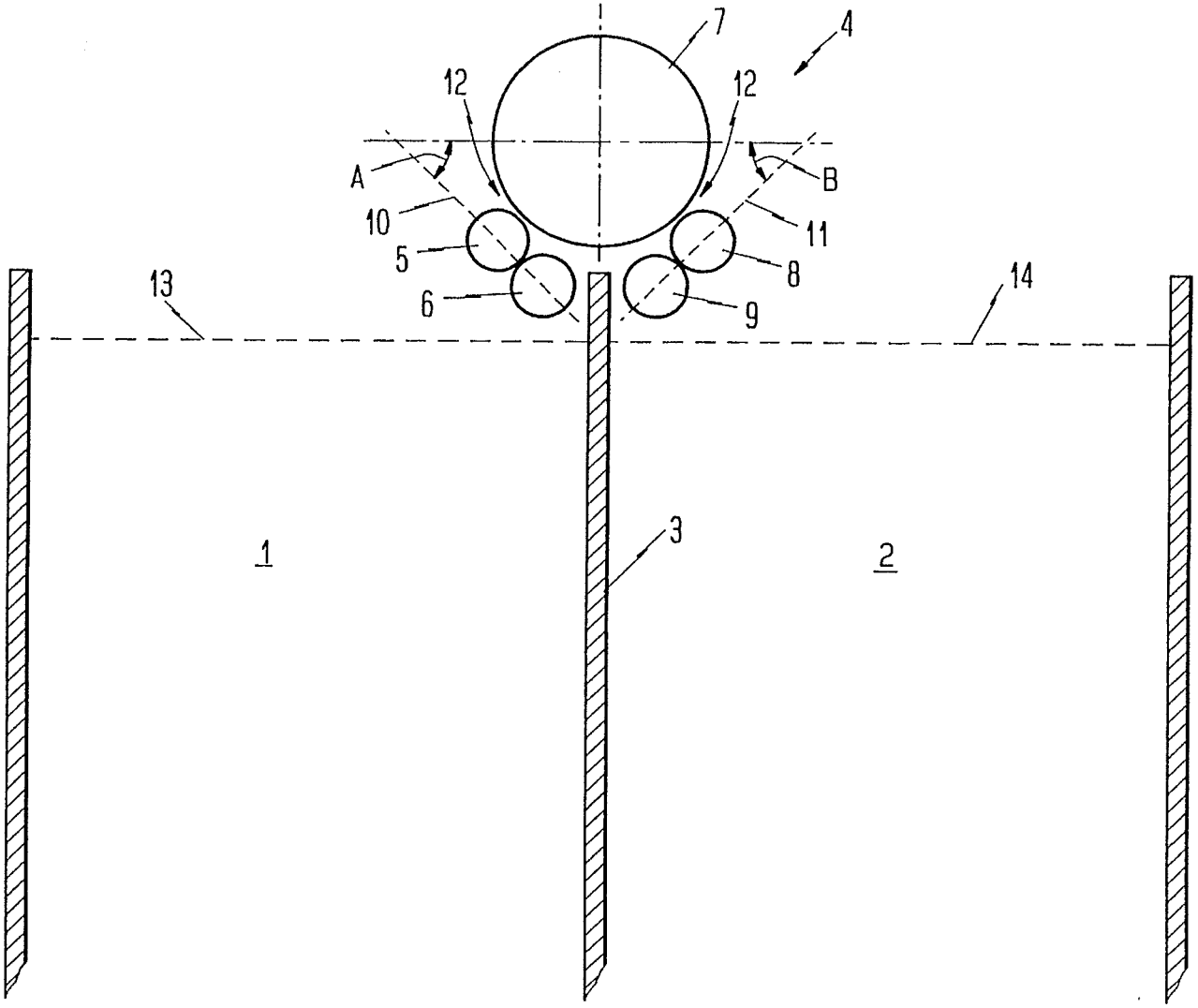
4
7
12
B
11
8
9
12
A
10
5
6
3
14
13
2
1

APPARATUS FOR WET PROCESSING PHOTOGRAPHIC SHEETS

FIELD OF THE INVENTION

The invention relates to an apparatus for processing photographic emulsion carriers.

BACKGROUND OF THE INVENTION

A known apparatus for developing individual photographic emulsion carriers in the form of sheets has two or more processing tanks. Sheets to be processed are continuously conveyed through one tank and into the next by pairs of transporting rollers in the tanks.

A difficulty with such apparatus is that the leading end of a sheet issuing from a first tank must be turned through nearly 180 degrees in order to enter the following tank. Currently, this is accomplished by means of a fixed guide located between the last pair of transporting rollers of an upstream tank and the first pair of transporting rollers of the neighboring downstream tank. Guides of this type are shown, for example, in the German patent 36 14 253.

The preceding arrangement damages the leading ends as well as the emulsions of the sheets. This leads to reductions in quality which are unacceptable to customers, especially during the development of paper copies of photographs.

SUMMARY OF THE INVENTION

It is an object of the invention to reduce or eliminate damage to the leading end of a sheet-like emulsion carrier during transfer from one processing container to another.

Another object of the invention is to reduce or eliminate damage to the emulsion of a sheet-like emulsion carrier when the carrier is transferred from a first processing container to a second.

An additional object of the invention is to provide a relatively economical unit capable of transferring a sheet-like emulsion carrier from an upstream processing container to a neighboring downstream processing container without substantial damage, or with no damage, to the article.

The preceding objects, as well as others which will become apparent as the description proceeds, are achieved by the invention.

One aspect of the invention resides in an apparatus for processing sheet-like emulsion carriers. The apparatus comprises a first processing container; a second processing container next to the first container; a pair of first or withdrawing rollers arranged to withdraw a sheet-like emulsion carrier from the first container; a pair of second or feeding rollers arranged to feed the emulsion carrier into the second container; and an additional or guide roller arranged to direct a leading end of the emulsion carrier from the withdrawing rollers to the feeding rollers. The withdrawing rollers have first axes which define a first plane inclined to the horizontal while the feeding rollers have second axes which define a second plane inclined to the horizontal. The withdrawing rollers cooperate with the feeding rollers to define a space and at least a portion of the additional roller is located in this space.

In the apparatus of the invention, the conventional fixed guide is replaced by a guide roller. Contrary to the deflection which occurs with the known guide, the leading end of a sheet-like emulsion carrier is not subjected to a potentially damaging slide along a surface. Instead, the leading end of the emulsion carrier is actively turned with virtually no sliding friction. It has been surprisingly found that even emulsion carriers having little stiffness and a strong tendency to roll up can be reliably advanced into the rollers serving to feed the carriers into a processing container.

The diameter of the guide roller may be a multiple of the diameters of the withdrawing rollers and/or the diameters of the feeding rollers. This allows reliability to be increased. Advantageously, the diameter of the guide roller is 3 to 5 times the diameters of the withdrawing rollers and/or the diameters of the feeding rollers.

Particularly good results can be achieved with a guide roller diameter of 35 to 70 mm and a diameter of 10 to 20 mm for the withdrawing rollers and/or the feeding rollers.

The gap between the guide roller and the feeding roller nearest the guide roller should be no larger than 2 mm and preferably lies in the range of 1 to 2 mm. This prevents the leading end of an emulsion carrier with little stiffness from entering such gap and thereby possibly disrupting operation.

It is of advantage for the withdrawing rollers and the feeding rollers to all have the same diameter. This permits the number of differing components, and hence the manufacturing costs, to be reduced.

The peripheral speeds of the withdrawing rollers, feeding rollers and guide roller are preferably all equal. This makes it possible to eliminate virtually all sliding friction between the roller surfaces and an emulsion carrier.

BRIEF DESCRIPTION OF THE DRAWING

Other features and advantages of the invention will be forthcoming from the following detailed description of preferred embodiments when read in conjunction with the accompanying drawing.

The single FIGURE schematically illustrates a photographic processing apparatus in accordance with the invention.

DESCRIPTION OF PREFERRED EMBODIMENTS

Referring to the sole FIGURE, the photographic processing apparatus shown is designed to process individual sheets of photographic material, that is, individual sheets having an emulsion on at least one side. The processing apparatus is here assumed to be an apparatus for developing exposed photographic sheets.

The apparatus includes a first processing tank or container 1 which accommodates a developing solution 13 and a second processing tank or container 2 which accommodates a bleach fixing solution 14. The tanks 1 and 2 are separated from one another by a dividing wall 3.

A transporting system is disposed in the developing solution 13 as well as in the fixing solution 14. These transporting systems are not illustrated since they do not constitute part of the invention per se. Each transporting system serves to continuously advance successive individual photographic sheets through the respective solution 13 or 14 along a predetermined path. The processing tank 2 is located downstream of the processing tank 1 as considered in the direction of travel of the photographic sheets and each sheet is conveyed into and through the developing solution 13 and then into and through the fixing solution 14.

A transferring unit 4 for guiding or directing the sheets from the tank 1 into the tank 2 is situated in the region of the upper end of the dividing wall 3. The transferring unit 4 includes a pair of withdrawing or first rollers 5,6 which are disposed on the side of the dividing wall 3 facing the tank 1. The transferring unit 4 further includes a pair of feeding or second rollers 8,9 on the side of the dividing wall 3 which faces the tank 2. The withdrawing rollers 5,6 serve to withdraw photographic sheets from the tank 1 while the feeding rollers 8,9 function to introduce photographic sheets into the tank 2. The two withdrawing rollers 5,6 and two feeding rollers 8,9 all have the same diameter.

The axes of rotation of the rollers 5,6,8,9 are parallel to one another. The axes of rotation of the withdrawing rollers 5,6 lie in a plane 10 which is inclined to the horizontal at an angle A having a magnitude of 30 to 60 degrees. Similarly, the axes of rotation of the feeding rollers 8,9 are located in a plane 11 which is inclined to the horizontal at an angle B likewise having a magnitude of 30 to 60 degrees. In the illustrated embodiment, both the angle A and the angle B have a magnitude of 45 degrees.

The planes 10 and 11 are inclined in opposite directions and the withdrawing rollers 5,6 cooperate with the feeding rollers 8,9 to define a trough-like space. The transferring unit 4 additionally includes a guide roller 7 which projects into the trough-like space between the withdrawing rollers 5,6 and the feeding rollers 8,9. The axis of rotation of the guide roller 7 is parallel to the axes of rotation of the rollers 5,6,8,9 and is situated directly above the dividing wall 3. The five rollers 5,6,7,8,9 are driven at the same peripheral speed.

The withdrawing roller 5 and feeding roller 8 cooperate with the guide roller 7 to bound the trough-like space between the withdrawing rollers 5,6 and the feeding rollers 8,9 from above. The guide roller 7 defines a gap 12 with the withdrawing roller 5 as well as the feeding roller 8, and the widths of the gaps 12 are no greater than 2 mm in order to prevent very flexible sheets from entering the gaps 12. The gap widths are preferably in the range of 1 to 2 mm.

In operation, an individual sheet leaving the developing solution 1 is gripped by the withdrawing rollers 5,6 which advance the sheet towards the guide roller 7 until the leading end of the sheet contacts the surface of the guide roller 7. Since the guide roller 7 is driven, the leading end of the sheet is pulled along by the guide roller 7 with virtually no sliding friction and turned towards the feeding rollers 8,9. Once the leading end of the sheet has been gripped by the feeding rollers 8,9, the sheet is transported smoothly over the problematic separation between the tanks 1 and 2 without damage to the surface of the sheet by scratching. The feeding rollers 8,9 advance the sheet to the transporting system in the tank 2.

The diameter of the guide roller 7 is advantageously 3 to 5 times the diameter of a roller 5, 6, 8 or 9. This allows the reliability of the transferring unit 4 to be increased. Particularly good results can be obtained with a diameter of 35 to 70 mm for the guide roller 7 and a diameter of 10 to 20 mm for the rollers 5,6,8,9.

The developing apparatus can, of course, have more than two tanks and more than one transferring unit.

Various modifications can be made within the meaning and range of equivalence of the appended claims.

I claim:

1. An apparatus for-processing sheet-like emulsion carders, comprising:

a first processing container;

a second processing container next to said first container;

a pair of first rollers arranged to withdraw a sheet-like emulsion carder from said first container, said first rollers having first axes which define a first plane inclined to the horizontal;

a pair of second rollers arranged to feed the carder into said second container, said second rollers having second axes which define a second plane inclined to the horizontal, and said first rollers cooperating with said second rollers to define a space; and an additional roller arranged to direct a leading end of the carder from said first rollers to said second rollers, at least a portion of said additional roller being located in said space, said first rollers have first diameters and said second rollers have second diameters, said additional roller having an additional diameter, which is greater than at least one of said first and second diameters.

2. The apparatus of claim 1, wherein at least one of said planes is inclined to the horizontal at an angle in the range of about 30 to about 60 degrees.

3. The apparatus of claim 2, wherein each of said planes is inclined to the horizontal at an angle in said range.

4. The apparatus of claim 1, wherein said first rollers have first diameters and said second rollers have second diameters, said additional roller having an additional diameter which is about 3 to about 5 times greater than at least one of said first and second diameters.

5. The apparatus of claim 4, wherein said additional diameter is about 3 to about 5 times greater than each of said first and second diameters.

6. The apparatus of claim 1, wherein said first rollers have first diameters, said second rollers have second diameters and said additional roller has an additional diameter, at least one of said first and second diameters being in a first range of about 10 to about 20 mm, and said additional diameter being in a second range of about 35 to about 70 mm.

7. The apparatus of claim 6, wherein each of said first and second diameters is in said first range.

8. The apparatus of claim 1, wherein one of said second rollers is located nearer said additional roller than the other of said second rollers, said one second roller and said additional roller defining a gap having a width in the range of about 1 to about 2 mm.

9. The apparatus of claim 1, wherein said first rollers have first diameters and said second rollers have second diameters, all of said diameters being substantially the same.

* * * * *

UNITED STATES PATENT AND TRADEMARK OFFICE

CERTIFICATE OF CORRECTION

PATENT NO. : 5,483,315

DATED : January 9, 1996

INVENTOR(S) : Wilfried HEHN

It is certified that error appears in the above-indentified patent and that said Letters Patent is hereby corrected as shown below:

Title page, [73], Assignee:, change "Aktiengesellschft" to --Aktiengesellschaft--.

Signed and Sealed this

Twenty-third Day of April, 1996

Bruce Lehman

*Attest:*

BRUCE LEHMAN

*Attesting Officer*

*Commissioner of Patents and Trademarks*